US006051935A

United States Patent [19]

Bucks et al.

[11] Patent Number: 6,051,935

[45] Date of Patent: Apr. 18, 2000

[54] CIRCUIT ARRANGEMENT FOR CONTROLLING LUMINOUS FLUX PRODUCED BY A LIGHT SOURCE

[75] Inventors: Marcel J. M. Bucks; Engbert B. G. Nijhof, both of Eindhoven, Netherlands

[73] Assignee: U.S. Philips Corporation, New York, N.Y.

[21] Appl. No.: 09/128,146

[22] Filed: Aug. 3, 1998

[30] Foreign Application Priority Data

Aug. 1, 1997 [EP] European Pat. Off. ..... 97202403

[51] Int. Cl.[7] ..... H05B 37/03

[52] U.S. Cl. ..... 315/224; 315/307; 315/247

[58] Field of Search ..... 315/307, 291, 315/224, DIG. 7, DIG. 5, 308, 247

[56] References Cited

U.S. PATENT DOCUMENTS

| | | | |
|---|---|---|---|
| 3,913,002 | 10/1975 | Steigerwald et al. | 315/224 |
| 4,812,736 | 3/1989 | Albach et al. | 323/224 |
| 4,900,989 | 2/1990 | Suenaga et al. | 315/224 |
| 5,459,478 | 10/1995 | Bolger et al. | 345/46 |
| 5,532,526 | 7/1996 | Lammers | 307/125 |
| 5,654,611 | 8/1997 | Yamamoto et al. | 315/308 |

*Primary Examiner*—Don Wong
*Assistant Examiner*—Wilson Lee
*Attorney, Agent, or Firm*—Robert J. Kraus

[57] ABSTRACT

A circuit arrangement for driving a light source includes input terminals (T1, T2) for deriving a supply current from a supply source; a circuit I for generating a control signal S; a circuit II, provided with a converter which is fitted with at least one switching element (13) and with a control circuit (17) which triggers the switching element with high frequency in a manner which is dependent on the value of the control signal S; a circuit III for generating a voltage Sc which is a measure for an instantaneous value of a supply voltage delivered by the supply source, the voltage Sc acting as a reference signal which causes the circuit I to generate a control signal S which lies alternately in a first range and in a second range, and the circuit II causing the drawing of a comparatively strong supply current (Iv1) at a value of the control signal S which lies in the first range, and the drawing of a comparatively weak supply current (Iv2) at a value of the control signal S which lies in the second range; and output terminals (T3, T4) coupled to the circuit II for connection to a light source (LI).

4 Claims, 6 Drawing Sheets

CIRCUIT ARRANGEMENT FOR CONTROLLING LUMINOUS FLUX PRODUCED BY A LIGHT SOURCE

BACKGROUND OF THE INVENTION

1. Field of the Invention

The invention relates to a circuit arrangement comprising: input terminals for deriving a supply current from a supply source, means I for generating a control signal S, means II provided with a converter which is fitted with at least one switching element and with control means which trigger said switching element with high frequency in a manner which is dependent on the value of the control signal S, means III for generating a voltage Sc which is a measure for an instantaneous value of a supply voltage delivered by the supply source and output terminals coupled to the means II for connection to a light source.

2. Description of Related Art

A circuit arrangement of a kind described in the opening paragraph is known from European Patent Specification EP 507 393, corresponding to U.S. Pat. No. 5,196,768. The known circuit arrangement, when connected to a supply source which delivers a sinusoidal supply voltage, draws a supply current of approximately corresponding shape. The means III of the known circuit arrangement is formed by a rectifier circuit. An up-converter is operated by means of the voltage generated by the rectifier circuit. The control signal is generated by detection means which measures a charging current of capacitive means which is supplied by the up-converter. Such a circuit arrangement may serve for supplying a semiconductor light source.

The comparatively high luminous efficacy, of the order of 15 lm/W, and the long life, a few tens of thousands of hours, of semiconductor light sources render them attractive for use as traffic lights. At the moment, traffic lights are usually constructed as incandescent lamps. Solid state relays (SSRs), provided with a TRIAC switching element and a control circuit, are mostly used for switching traffic lights. The SSRs operate reliably at the comparatively high loads, of the order of 150 W, of the incandescent lamps used.

If a semiconductor light source is used as a traffic light, however, a much smaller load, of the order of 15 W or less can suffice. It may happen that the TRIAC does not enter a conducting state when such a semiconductor light source is operated in conjunction with a known circuit arrangement and an existing SSR. A supply current drawn from the SSR in that case, flows mainly through the control circuit and may damage the latter.

SUMMARY OF THE INVENTION

It is an object of the invention to provide a circuit arrangement of the kind described in the opening paragraph which can be connected to existing SSRs without the risk of damage to the control circuit.

According to the invention, this object is realized in that the voltage Sc acts as a reference signal which causes the means I to generate a control signal S which lies alternately in a first range and in a second range, while the means II causes the drawing of a comparatively strong supply current at a value of the control signal S which lies in the first range and the drawing of a comparatively weak supply current at a value of the control signal S which lies in the second range.

Since the control signal lies alternately in the first and in the second ranges, the circuit arrangement, on the one hand, draws a comparatively strong supply current from the supply source, so that the SSRs switch on reliably and damage to the control circuit is avoided. On the other hand, the effective value of the supply current drawn from the supply source, and thus the power derived from the supply source, remains low. A control of the supply current drawn from the supply source can be realized in a simple manner in that the duty cycle and/or the frequency of the control means of the converter are influenced by the control signal S. The supply source here acts as an AC voltage generator which causes the control signal S to lie alternately in the first and in the second range by means of the reference signal Sc. Separate means for achieving this are thus redundant.

The converter may be constructed, for example, as a resonant half-bridge circuit, as a flyback converter, or as a combination of a boost converter with another type of converter, for example, a combination of a boost converter and a down-converter. A multiresonant forward/flyback converter is favorable for achieving a high power factor.

The alternate drawing of a strong supply current and a weak supply current is not necessary under all circumstances. It is found to be sufficient in practice, if this is done at low temperatures only.

It is favorable for achieving a high power factor when the means I generates from the reference signal Sc, a control signal S which lies in the first range for a comparatively high absolute instantaneous value of the supply voltage, and which lies in the second range for a comparatively low absolute instantaneous value of the supply voltage.

The circumstances in which the circuit arrangement according to the invention is operated, such as, the supply voltage and the ambient temperature, may vary strongly in practice. An attractive embodiment of the circuit arrangement according to the invention is characterized in that the means I, II, and III form part of a control system for controlling a luminous flux delivered by the light source, this control system in addition, comprising means IV for generating an error signal Sf which is a measure of the difference between a power consumed by the light source and a desired value, while the control signal S generated by the means I is also partly dependent on the error signal Sf. The power to be dissipated for achieving a desired luminous flux value may be controlled in a simple manner through adaptation of the relative duration of the period during which a comparatively strong supply current is drawn. The relative duration is understood to be the time duration in which a comparatively strong supply current is drawn in each cycle of the supply voltage divided by the duration of the cycle. Since the means I, II, and III are already present for alternately drawing a comparatively strong and a comparatively weak supply current, it is achieved, in a simple manner in this embodiment, that the luminous flux generated by the light source will correspond approximately to the desired value in spite of widely differing conditions.

It is favorable when the means IV is provided with means V for generating a signal Si from a current consumed by the light source, means VI for generating a signal St from an ambient temperature in an ambience of the light source, and means VII for calculating the error signal Sf from the signal Si and the signal St. This embodiment is highly suitable for a semiconductor light source. The voltage across a semiconductor light source is usually dependent on the current passing through it to a low degree only. The signal Si accordingly, is also a measure for the power consumed by the semiconductor light source. The luminous efficacy of a semiconductor light source is usually dependent on the ambient temperature. The means VI thus renders it possible, in a simple manner, to obtain from the ambient temperature an estimate of the desired value of the power to be consumed by the semiconductor light source.

It is favorable when the means I is provided with means I' for causing the control signal to change upon a decrease in the error signal Sf, this change causing the means II to generate an increase in the comparatively strong supply current. It may happen, in the case of high temperatures and a low supply voltage, that the control signal S lies in the second range already during the entire cycle of the supply voltage. It is not possible then to cause the power consumed by the circuit arrangement to rise through an increase in the relative duration of the time during which a comparatively strong supply current is drawn. The means I' ensures that, under these circumstances, the power consumed by the circuit arrangement can rise further in that the value of the comparatively strong supply current is increased. This renders it possible to keep the luminous flux delivered by the semiconductor light source constant over a wider range of ambient temperatures than would be the case without the means I'.

BRIEF DESCRIPTION OF THE DRAWINGS

These and other aspects of the circuit arrangement according to the invention are explained in more detail with reference to the drawings, in which FIG. 1 diagrammatically shows a circuit arrangement according to the invention.

DESCRIPTION OF THE PREFERRED EMBODIMENTS

Figure 1:
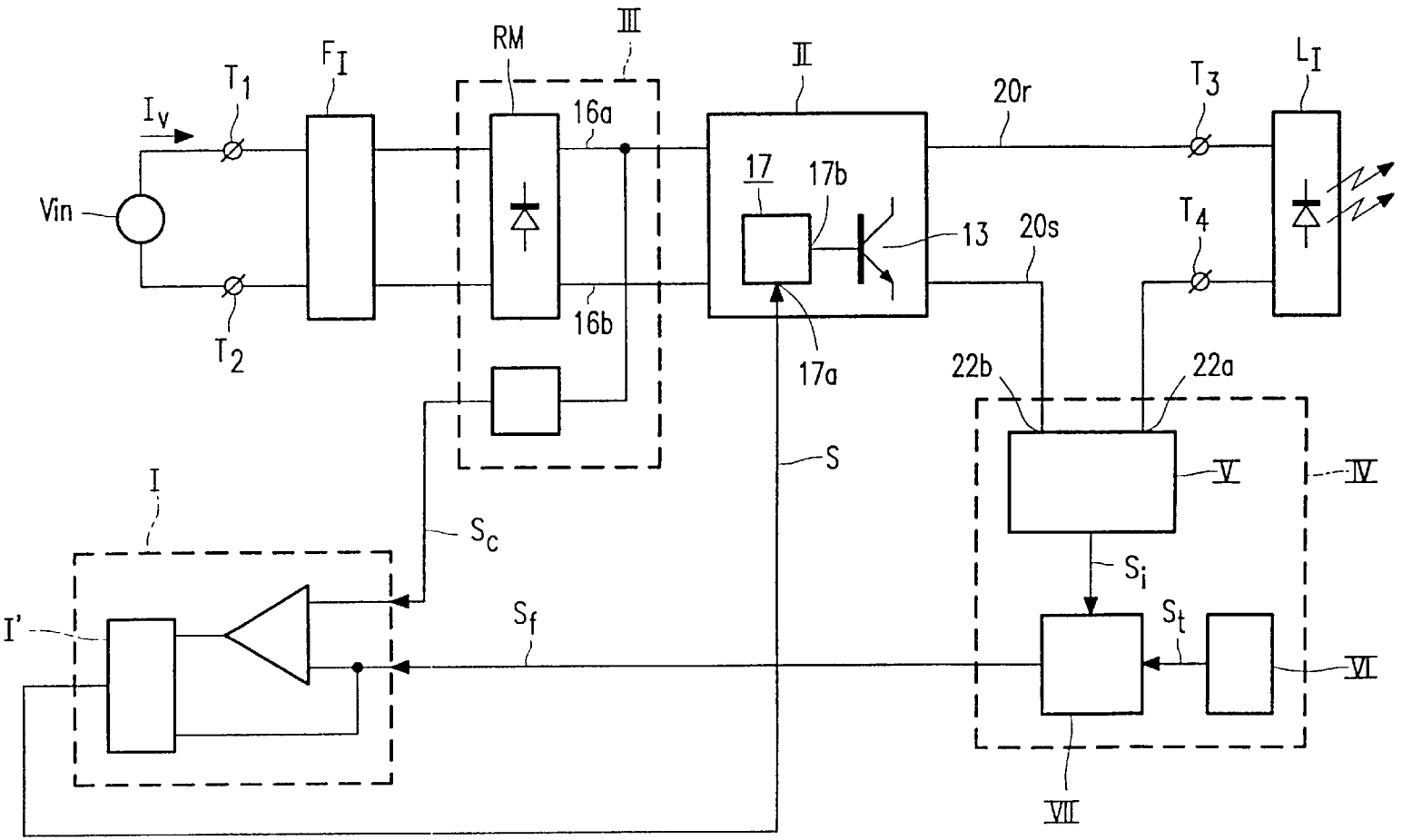

FIG. 1 diagrammatically shows a circuit arrangement provided with input terminals T1, T2 for drawing a supply current from a supply source (Vin). The input terminals T1, T2 are connected to rectifier means RM via an input network FI which comprises inter alia, a low-pass filter. The rectifier means RM is constructed, for example, as a diode bridge. Means II, to which output terminals T3, T4 are coupled for connecting a light source LI, is supplied through the rectifier means. The means II is provided with a converter which is fitted with at least one switching element 13 and with control means 17. The means I generates a control signal S. The control means 17 switches the switching element with high frequency in a manner which is dependent on the value of the control signal S. The circuit arrangement is further provided with means III for generating a voltage Sc which is a measure for an instantaneous value of a supply voltage delivered by the supply source. The rectifier means RM forms part of the means III.

The voltage Sc serves as a reference signal which causes the means I to generate a control signal S which lies alternately in a first and in a second range. The means II ensures that a comparatively strong supply current is drawn when the control signal S has a value lying in the first range and that a comparatively weak supply current is drawn when the value of the control signal S lies in the second range.

The control signal S lies in a first range when the supply voltage has a comparatively high absolute instantaneous value. The control signal lies in a second range when the supply voltage has a comparatively low absolute instantaneous value.

A semiconductor light source LI is connected here to the output terminals T3, T4 which are coupled to the means II. One of the output terminals T3 is directly connected to the means II. The other output terminal T4 is connected to the means II via means V. The means V generates a signal Si which is a measure for a current consumed by the semiconductor light source. The means V forms part of means IV for generating an error signal Sf which is a measure for the difference between a luminous flux supplied by the semiconductor light source and a desired luminous flux. The control signal generated by the means I is partly dependent on the error signal Sf. The means IV is further provided with means VI and means VII. The means VI generate a signal St which is a measure for an ambient temperature of the semiconductor light source LI. The means VII calculates the error signal Sf from the signal Si and the signal St.

The value of the control signal S is also dependent on the error signal Sf. The means I is provided with means I' for causing a change in the control signal in the case of a decreasing error signal such that this control signal causes the means II to increase the value of the comparatively strong supply current.

Figure 2:
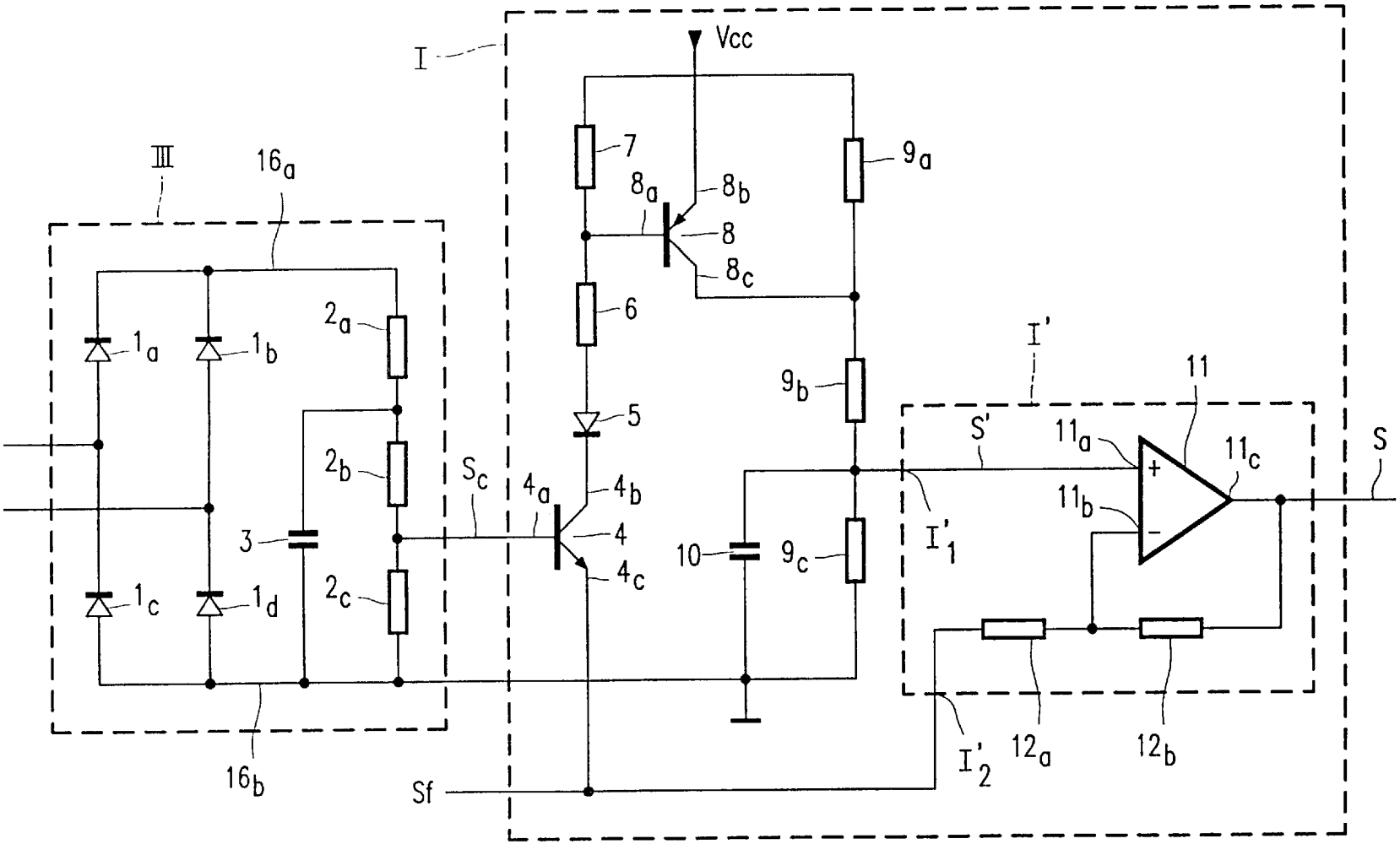
FIG. 2 shows a circuit diagram of the means I and III.

FIG. 2 is a more detailed diagram of an embodiment of the means III for generating a reference signal Sc which is a measure for the instantaneous absolute value of the low-frequency supply voltage, and of the means I for generating the control signal S. The supply voltage is rectified by means of the diode bridge 1*a*–1*d*. The diode bridge forms the rectifier means RM. The output of the diode bridge is shunted by a voltage divider comprising the resistive impedances 2*a*, 2*b*, 2*c*. Part of the voltage divider formed by the resistive impedances 2*b* and 2*c* is shunted by a capacitive impedance 3. A common junction point of the latter two resistive impedances supplies the reference signal Sc which is approximately proportional to the absolute instantaneous value of the supply voltage.

In a further embodiment of the means III, the forming of the reference signal Sc is done by way of a branch at an input of the diode bridge formed by a diode resistor network which is switched between supply voltage conductors of the diode bride input. This embodiment has an advantage that informing the reference signal Sc, the amplitude of the supply voltage is closely followed.

The means I for generating a control signal S from the reference signal Sc comprises a semiconductor switch 4 whose control electrode 4*a* receives the reference signal Sc from the means III. An electrode 4*e* of the semiconductor switch, which here, at the same time serves, as a control electrode and as a main electrode, receives the error signal Sf. A main electrode 4*b* of the semiconductor switch 4 is connected to a terminal Vcc of a stabilized supply source via a series arrangement of a unidirectional element 5 and resistive impedances 6 and 7. A common junction point of said resistive impedances 6 and 7 is connected to a control electrode 8*a* of a second semiconductor switch 8. The semiconductor switch 8 shunts a resistive impedance 9*a* of a voltage divider which is in addition, provided with resistive impedances 9*b* and 9*c*. The voltage divider 9*a*, 9*b*, 9*c* connects the terminal Vcc to ground. The resistive impedance 9*c* is shunted by a capacitive impedance 10. A common junction point of the resistive impedances 9*b* and 9*c* is connected to a non-inverting input 11*a* of a differential amplifier 11. An inverting input 11*b* receives the error signal Sf via a resistive impedance 12*a*. An output LC supplies the control signal S to the means II. The inverting input 11*b* is connected to the output 11*c* via a resistive impedance 12*b*. The differential amplifier 11 and the resistive impedances 12*a* and 12*b* form the means I'.

The forming of the control signal S in the means I from comparing the reference signal Sc with the error signal Sf, is done in the described embodiment by way of a transistor circuit (transistors 4 and 8). In a further embodiment, this comparison is done by use of an i.c., for instance, an operational amplifier.

Figure 3:
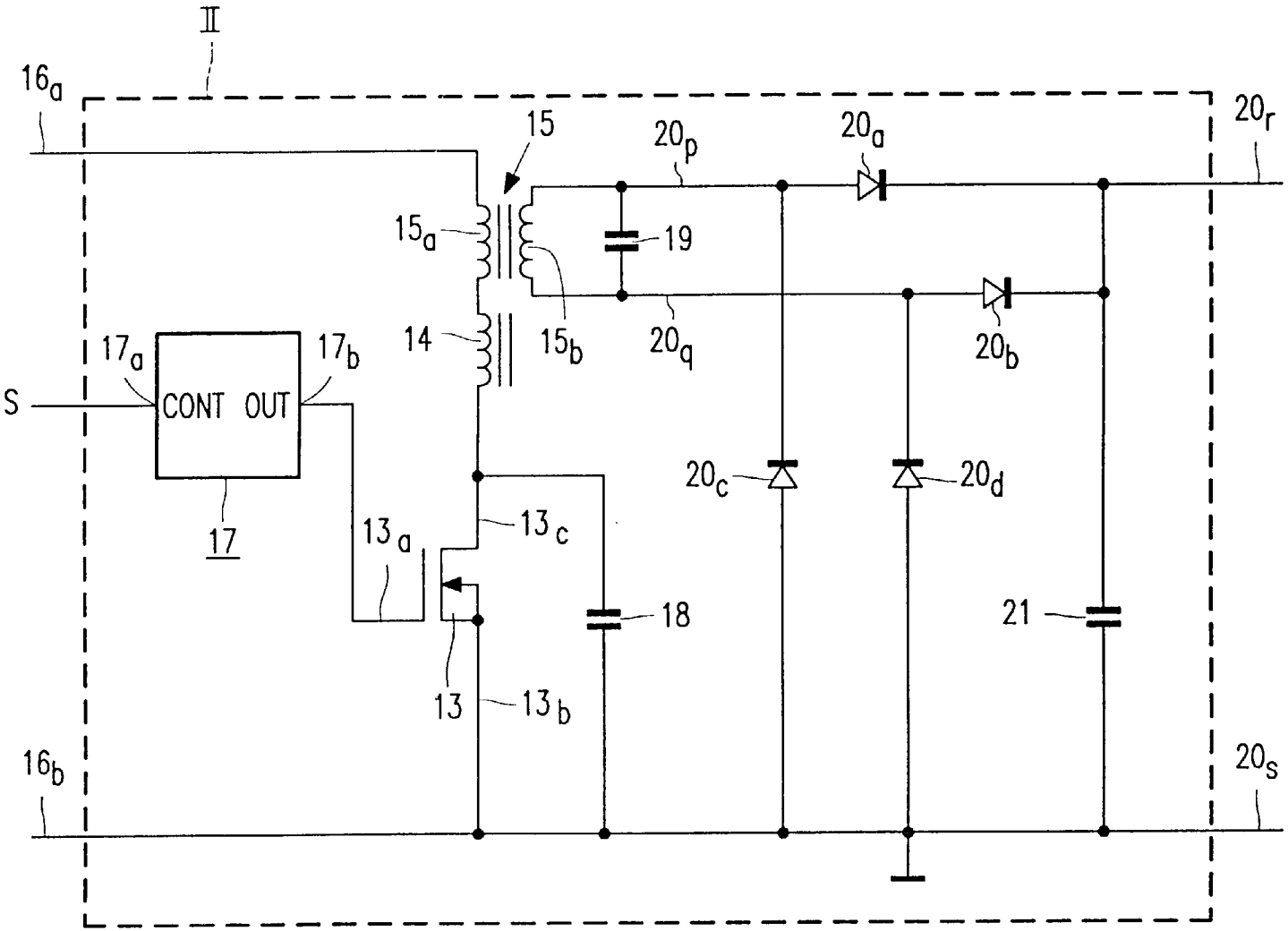
FIG. 3 shows a circuit diagram of the means II.

The means II, shown in more detail in FIG. 3, is constructed here as a multiresonant forward/flyback converter. The switching element 13, together with inductive impedance 14 and primary winding 15*a* of a transformer 15, constitutes a series circuit which shunts inputs 16*a*, 16*b*. A control electrode 13*a* of the switching element 13 is connected to an output 17*b* of control means 17. Main electrodes 13*b* and 13*c* of the switching element 13 are shunted by a capacitive impedance 18. A secondary winding 15*b* of the transformer 15 is shunted by a capacitive impedance 19 and is connected to inputs 20*p*, 20*q* of diode bridge 20*a*–20*d*. Outputs 20*r*, 20*s* of the diode bridge are shunted by a capacitive impedance 21. The control means 17 is formed by a timer which keeps the switching element 13 alternately switched off during a constant off-time and switched on during a variable on-time with a high frequency. The on-time is longer in proportion as the value of the control signal S is higher.

Figure 4:
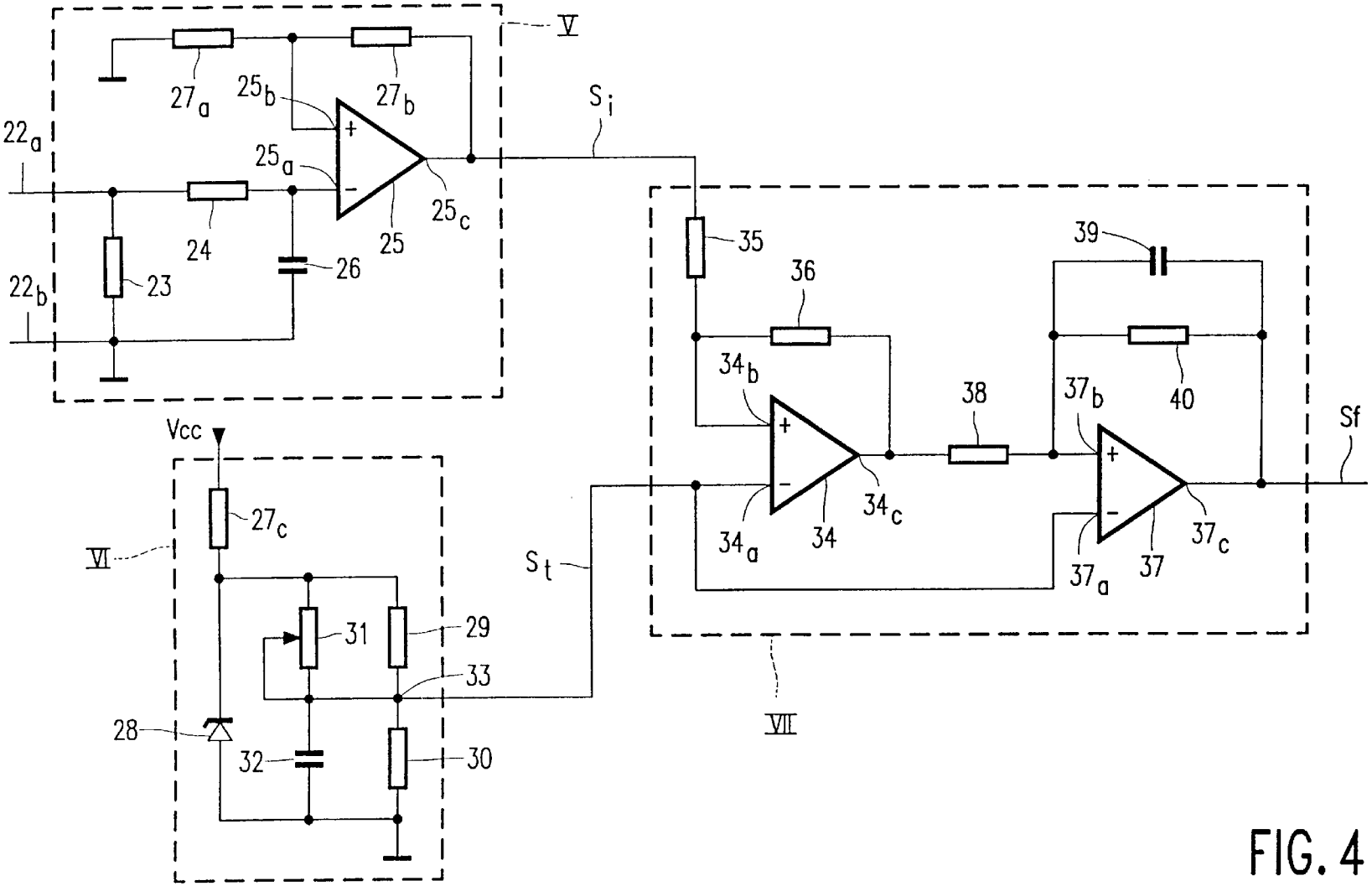
FIG. 4 shows the means IV, including the means V, VI, and VII.

The means IV for generating the error signal Sf is shown in more detail in FIG. 4. The means IV shown in FIG. 4 is provided with means V, VI, and VII. Inputs 22*a*, 22*b* of the means V are shunted by a resistive impedance 23. The input 22*a* is connected via a resistive impedance 24 to a non-inverting input 25*a* of a differential amplifier 25. The input 22*b* is connected to the non-inverting input 25*a* via a capacitive impedance 26. The input 22*b* is furthermore connected to an inverting input 25*b* of the differential amplifier 25 via a resistive impedance 27*a*. The output 25*c* and the input 25*b* of the differential amplifier 25 are interconnected via a resistive impedance 27*b*.

The means VI for generating a signal St, which is a measure for an ambient temperature of the light source LI is provided with a series arrangement of a resistive impedance 27*c* and a breakdown element 28. This series arrangement forms a connection between the terminal Vcc and ground. The breakdown element 28 is shunted by a series arrangement of the resistive impedances 29 and 30. The resistive impedance 29 is shunted by a resistive impedance 31 which has a negative temperature coefficient and will be referred to as the temperature-dependent resistive impedance hereinafter. The resistive impedance 30 is shunted by a capacitive impedance 32. A common junction point 33 of the resistive impedances 29 and 30 forms an output which delivers the signal St.

The output 33 of the means VI is connected to a non-inverting input 34*a* of differential amplifier 34. An inverting input 34*b* thereof is connected via a resistive impedance 35 to the output 25*c* of the means V. The output 34*c* and the inverting input 34*b* of the differential amplifier are interconnected via a resistive impedance 36. The output 33 of the means VI is also connected to a non-inverting input 37*a* of a differential amplifier 37. The inverting input 37*b* of this differential amplifier is connected to the output 34*c* of the differential amplifier 34 via a resistive impedance 38. A parallel circuit of a capacitive impedance 39 and a resistive impedance 40 connects the output 37*c* of the differential amplifier 37 to the inverting input 37*b* thereof.

The circuit arrangement shown operates as follows. When the input terminals T1 and T2 of the circuit arrangement are connected to a low-frequency supply source, for example, a 110 V, 60 Hz line voltage, the rectifier means RM will generate a DC voltage which varies with low frequency at the inputs 16*a*, 16*b* of the means II. The control means 17 brings the switching element 13 alternately into a conducting state during an on-time and into a non-conducting state during an off-time by means of a switching voltage Vs at the control electrode 13*a*. Due to the switching of the switching element 13, a current varying with high frequency will flow in the primary winding 15*a* of the transformer 15, so that a voltage varying with high frequency is induced in its secondary winding 15*b*. This latter voltage is converted into an approximately constant DC voltage by the diode bridge 20*a*–20*d* and the capacitive impedance 21. The semiconductor light source LI is supplied with this DC voltage.

Figure 5:
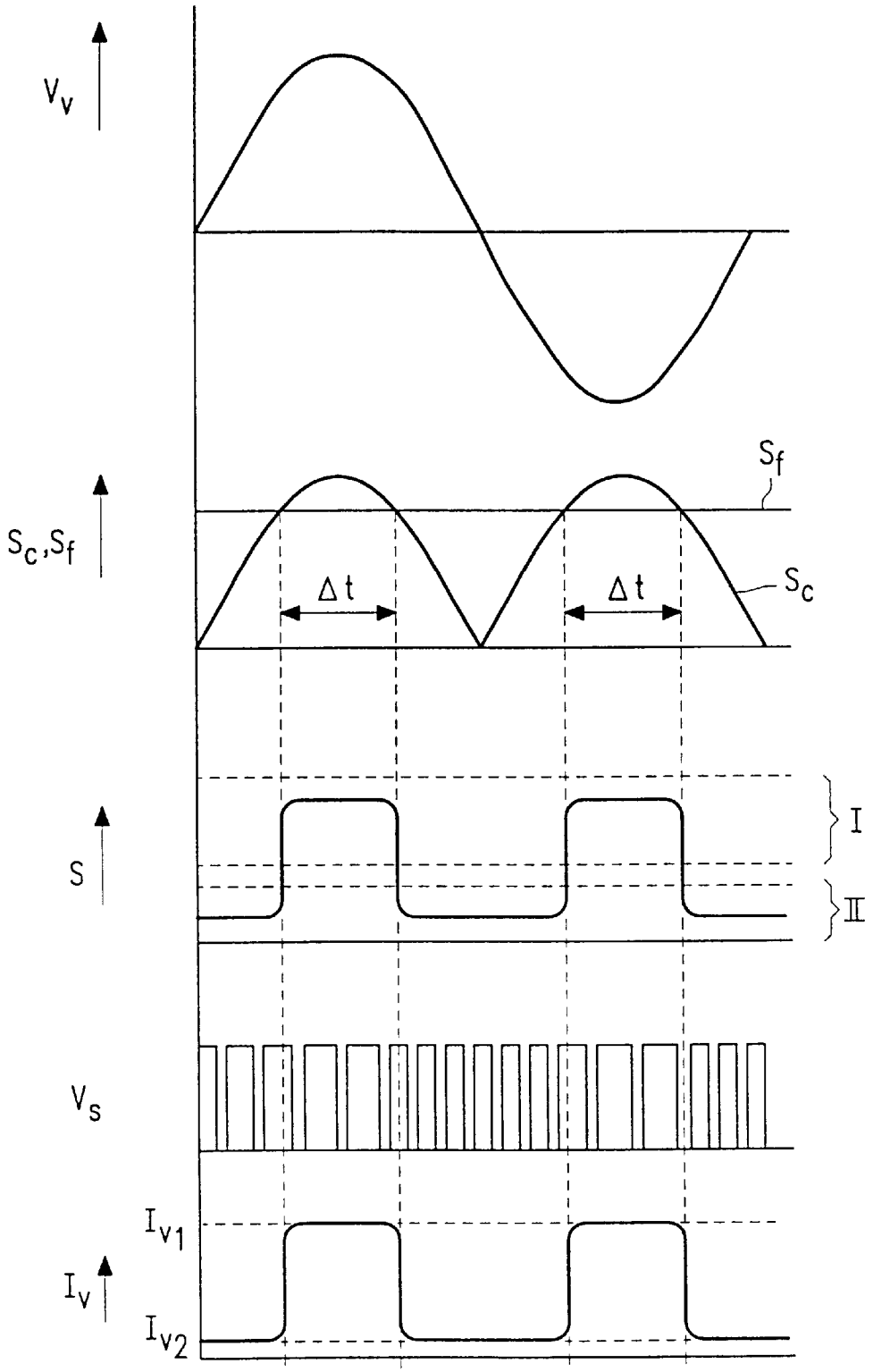
FIG. 5 diagrammatically depicts the gradient of the supply voltage Vv, the supply current Iv, and a few signals.

For clarification, FIG. 5 diagrammatically shows the gradients of the supply voltage Vv, the signals Sc and Sf, the control signal S, the switching voltage Vs, and the supply current Iv. A situation is drawn in FIG. 5, for the sake of clarity, in which the switching frequency of the converter is higher than the frequency of the supply source by only one order of magnitude. In reality, the switching frequency of the converter is usually much higher, for example, a few tens of kHz, than is the frequency of the supply source, for example, 50 or 60 Hz. The means III generates a signal Sc whose value is approximately proportional to the instantaneous value of the supply voltage Vv. The value of this signal Sc is higher than the error signal Sf augmented by the base-emitter voltage of the semiconductor switch 4 during an interval At in each half cycle of the supply voltage. The semiconductor switch 4 then assumes a conducting state, so that a current will flow through the branch 4–7. The result of this is a voltage drop across the resistive impedance 7, which brings the semiconductor switch 8 into a conducting state. The voltage S' at the non-inverting input 11*a* of the differential amplifier 11 rises as a result of this, and thus, also the voltage of the control signal S. The rise in voltage of the control signal S has the result that the duration of pulses of the switching voltage Vs increases. This also increases the on-time of the switching element 13. With this rise in the on-time of the switching element 13, the means II achieves that a comparatively strong supply current Iv1 is drawn from the supply source during the intervals Δt. The moment the signal Sc is lower again than the error signal Sf augmented by the base-emitter voltage of the semiconductor switch 4, the control signal S will decrease again. As a result of this, the on-time of the switching element 13 is reduced, so that the means II achieves that a comparatively weak supply current Iv2 is drawn from the supply source now.

Since the inputs 22*a*, 22*b* of the means V are connected in series with the semiconductor light source LI, a voltage will arise across the resistive impedance 23 which is proportional to the current consumed by the semiconductor light source LI. The voltage of the signal Si generated by the differential amplifier 25 is equal to the voltage across the resistive impedance 23 multiplied by a constant factor. Since the voltage across the LEDs is approximately constant, the signal Si is a measure for the power consumed by the LEDs.

A substantially constant voltage is generated across the network of resistive impedances 29, 30, 31 by means of the series arrangement of resistive impedance 27 and breakdown element 28 in the means VI. The resistance value of the temperature-dependent resistive impedance 31 decreases in proportion as the ambient temperature rises. The voltage of the signal St rises as a result of this. The resistive impedances 29, 30 and 31 can be chosen such that the voltage of the signal St, at the ambient temperatures occurring in practice, for example, over the range from −40° C. to +75° C., is approximately a measure for the power which the semiconductor light source LI must consume in order to supply the desired luminous flux. The differential amplifiers 34 and 37 of the means VII deliver a signal Sf whose voltage is approximately equal to a constant factor multiplied by the difference between the value of the signal Si and the value of the signal St. The value of the signal Si rises in proportion as the power consumed by the semiconductor light source LI becomes higher. The value of the error signal Sf, with which the signal Sc is compared, also rises in proportion as the difference between the value of the signal Si and that of the signal St becomes greater. Accordingly, a higher instantaneous absolute value of the supply voltage is also required for having the means II cause a comparatively strong supply current to be drawn. The time duration Δt of the interval during which a comparatively strong supply current is drawn from the supply unit, and thus the power consumed by the circuit arrangement, is limited thereby. The power consumed by the semiconductor light source LI is also limited thereby, so that this power adjusts itself at a value close to a value desired for a given ambient temperature.

In a practical realization, the semiconductor light source LI is provided with a circuit comprising eighteen LEDs. The eighteen LEDs are arranged in three series circuits of six LEDs each. Each of the junction points between two consecutive LEDs in one of the series circuits is connected therein to a corresponding junction point in the other two series circuits. The LEDs used each has a voltage of 2.5+0.5 V for a current of 250 mA. The diode bridge 1*a*–1*d* in this practical realization is constructed with diodes of the 1N4007 type. The unidirectional element 5 is a diode of the 1N418 type. In the diode bridge 20*a–d*, 20*a* and 20*b* are jointly constructed as diodes having a common cathode, type BYV118F. 20*c* and 20*d* are diodes of the BYV10–40 type. The breakdown element 28 is a zener diode having a breakdown voltage of 6.2 V, type 1N825. The semiconductor switches 4 and 8 are formed by transistors of the BCX70 type. An FET of the STP3N100 type serves as the switching element 13. The differential amplifiers 11, 25, 34, and 37 are constructed as operational amplifiers of the NE532 type. The control means 17 is formed by a timer IC, type NE7555. Pins 5 and 3 of this IC form the input 17*a* and the output 17*b*, respectively, of the control means shown in FIG. 3. The inductive impedance 14 has an inductance value of 600 μH. The ratio of the number of turns of the primary winding to that of the secondary winding of the transformer 15 is 4. The temperature-dependent resistive impedance 31 is constructed as an NTC, made by Philips, type 2322 640 90106. The stabilized voltage source for generating the voltage at terminal Vcc is of the LM78L09 type. The other components have values as listed in the following Table:

| | | | | | |
|---|---|---|---|---|---|
| 2a | 82 k 2b | 68 kΩ | 2c | 6.8 kΩ | |
| 3 | 4.7 nF | 6 | 47 kΩ | 7 | 100 kΩ |
| 9a | 20 kΩ | 9b | 10 kΩ | 9c | 15 kΩ |
| 10 | 33 nF | 12a | 68 kΩ | 12b | 10 kΩ |
| 18 | 4.7 nF | 19 | 267 nF (220 nF // 47 nF) | | |
| 21 | 470 μF | 23 | 1 Ω | 24 | 100 kΩ |

-continued

| | | | | | |
|---|---|---|---|---|---|
| 26 | 10 nF | 27a | 1.3 kΩ | 27b | 6.8 kΩ |
| 27c | 10 kΩ | 29 | 82 kΩ | 30 | 68 kΩ |
| 32 | 100 nF | 35 | 1 kΩ | 36 | 1 kΩ |
| 38 | 33 kΩ | 39 | 68 nF | 40 | 1 MΩ |

To investigate the behavior of the circuit arrangement according to the invention, the current Iv drawn from the supply source was measured as a function of time t. The circuit arrangement was operated on a supply source having a frequency of 60 Hz. The effective value Veff of the voltage supplied by the supply source was varied. In addition, various ambient temperatures Tamb were simulated. The simulation of the ambient temperature took place in that the temperature-dependent resistive impedance 31 was replaced by a resistive impedance not dependent on temperature and having a resistance value which the temperature-dependent resistive impedance 31 would have at the temperature to be simulated, i.e.: 332 kΩ at −40° C., 10 kΩ at 25° C., and 1.5 kΩ at 74° C.

Figure 6A:
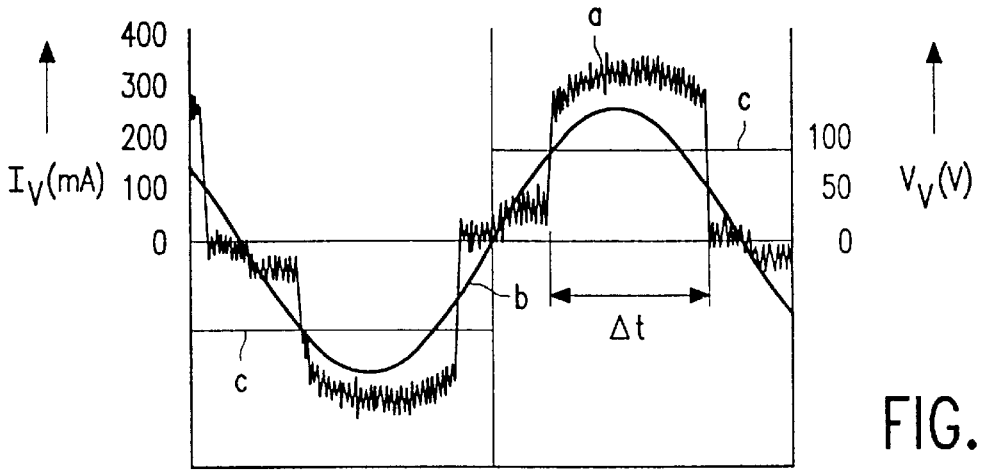
FIGS. 6A, 6B, and 6C show the measured gradient of the supply voltage Vv and the supply current Iv under various conditions.
Figure 6B:
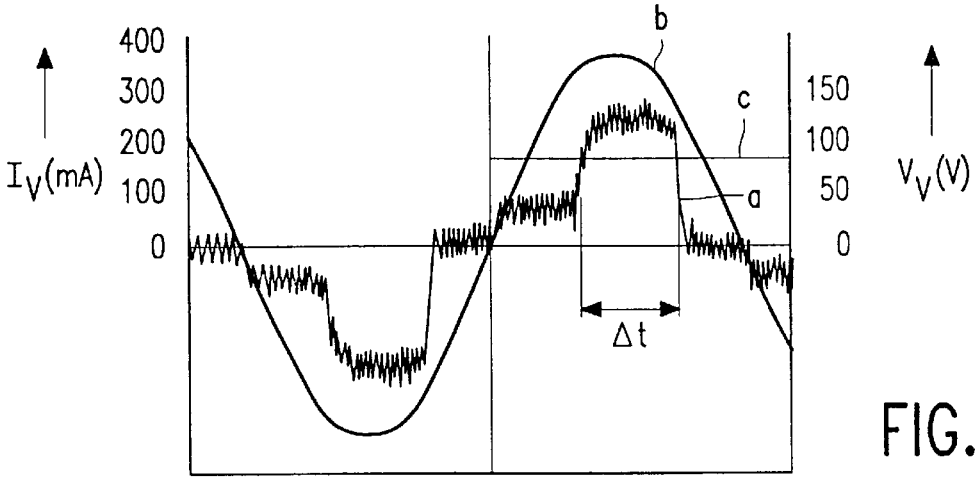
Figure 6C:
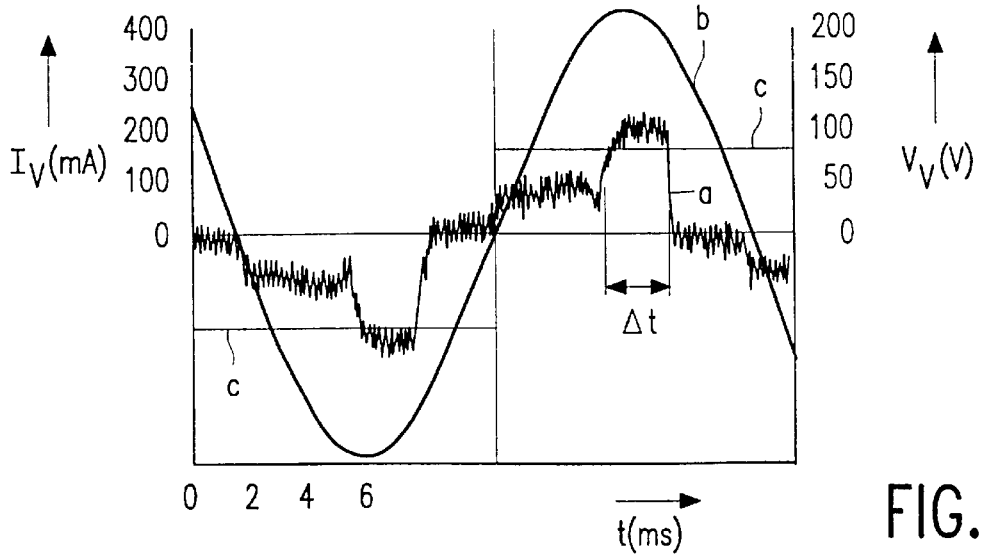

FIGS. 6A, 6B, 6C show test results of the circuit arrangement according to the invention under circumstances corresponding to Veff=80 V, Tamb=74° C.; Veff=117 V, and Tamb=25° C.; and Veff=135 V, Tamb=−40° C., respectively. In these Figures, curve a represents the current Iv (mA) drawn from the supply source as a function of time t (ms) during a cycle of the supply voltage Vv (V) (curve b). Line c is the 150 mA level of the supply current which must be drawn from the supply source during each cycle in order to have the SSR switch on reliably. In FIGS. 6A, 6B, and 6C, the durations of the interval Δt are 5.2 ms, 3.3 ms, and 2 ms, respectively. The value of the comparatively strong supply current which the circuit arrangement draws from the supply source during the interval Δt is higher than the minimum requirement of 150 mA in each of the widely differing circumstances investigated, which renders possible a reliable switching-on of the SSRs.

The semiconductor light source LI requires a comparatively high power for supplying the desired luminous flux at high temperatures. The error signal Sf has a comparatively low value under these circumstances. A lower value of the error signal Sf at input I2' of the means I' results in a higher voltage at the output of the differential amplifier 11. As a result, the voltage of the control signal S has a value which is higher than in the case of a lower value of the error signal Sf both in the first range and in the second range. In the practical realization described here, the value of the control signal S in the first range rises from 4.7 V to 6.2 V for a decrease in the error signal Sf from 10 V down to 0 V. In the second range, the value of the control signal S rises from 2.0 V to 3.5 V for this same decrease of the error signal. The means I' enables the circuit arrangement to increase the consumed power also where an increase in the interval Δt is no longer possible.

What is claimed is:

1. A circuit arrangement comprising:

input terminals for deriving a supply current from a supply source;

means I for generating a control signal;

means II comprising a converter having at least one switching element and control means for triggering said switching element with high frequency in dependence on a value of the control signal;

means III for generating a voltage which is a measure of an instantaneous value of a supply voltage delivered by the supply source; and output terminals coupled to the means II for connection to a light source, characterized in that the voltage generated by the means III acts as a reference signal which causes the means I to generate the control signal alternately in a first range and in a second range, while the means II causes a drawing of a comparatively strong supply current when the control signal lies in the first range, and a drawing of a comparatively weak supply current when the control signal lies in the second range, said means I, II, and III forming part of a control system for controlling a luminous flux delivered by the light source, said control system further comprising means IV for generating an error signal which is a measure of a difference between a power consumed by the light source and a desired value, the control signal generated by the means I being also partly dependent on the error signal.

2. A circuit arrangement as claimed in claim 1, characterized in that the control signal lies in the first range for a comparatively high absolute instantaneous value of the supply voltage, and the control signal lies in the second range for a comparatively low absolute instantaneous value of the supply voltage.

3. A circuit arrangement as claimed in claim 1, characterized in that the means IV comprises:

means V for generating a signal from a current consumed by the light sources;

means VI for generating a signal from an ambient temperature in an ambience of the light source; and means VII for calculating the error signal from the signal generated by the means V and the signal generated by the means VI.

4. A circuit arrangement as claimed in claim 1, characterized in that the means I comprises means I' for causing the control signal to change upon a decrease in the error signal, said change causing the means II to generate an increase in the comparatively strong supply current.

* * * * *